US007204323B2

(12) United States Patent
Kingsley

(10) Patent No.: US 7,204,323 B2
(45) Date of Patent: Apr. 17, 2007

(54) CLEAN-MOLE™ REAL-TIME CONTROL SYSTEM AND METHOD FOR DETECTION AND REMOVAL OF UNDERGROUND MINERALS, SALTS, INORGANIC AND ORGANIC CHEMICALS UTILIZING AN UNDERGROUND BORING MACHINE

(75) Inventor: Gordon Bruce Kingsley, Granite Bay, CA (US)

(73) Assignee: Gordon B. Kingsley, Truckee, CA (US)

( * ) Notice: Subject to any disclaimer, the term of this patent is extended or adjusted under 35 U.S.C. 154(b) by 0 days.

(21) Appl. No.: 10/688,317

(22) Filed: Oct. 18, 2003

(65) Prior Publication Data

US 2005/0082091 A1 Apr. 21, 2005

(51) Int. Cl.
*E21B 21/06* (2006.01)
*E21B 49/08* (2006.01)
*E21B 7/04* (2006.01)

(52) U.S. Cl. ..... 175/46; 175/58; 175/62

(58) Field of Classification Search ..... 175/40, 175/46, 50, 58–62

See application file for complete search history.

(56) References Cited

U.S. PATENT DOCUMENTS 4,299,295 A * 11/1981 Gossard ..... 175/45
2004/0108110 A1* 6/2004 Zupanick ..... 166/245

* cited by examiner

*Primary Examiner*—Zakiya W. Bates

(57) ABSTRACT

Systems and methods are described for detection and removal of underground organic and inorganic compounds utilizing underground boring tool technology. Typically a drilling fluid is flowed through a pipe or drill string, over the boring tool, and back up the bore hole to the surface in order to remove cuttings and dirt at the surface. Solids and liquids discharged at the surface are analyzed real-time to determine concentrations and locations of compounds in the subsurface and determine the geology of the formation. Detectors can also be attached directly to the head of the boring apparatus and data transmitted to the surface electronically or by other means. Data is processed and evaluated. Based on this information, the boring tool is continually re-directed along an underground path to the areas with the highest concentrations of minerals, oil, gas, toxic compounds or other elements or compounds of interest. Once located, various technologies are employed to remove and transport compounds to the surface for treatment or sale.

3 Claims, 2 Drawing Sheets

Figure 1:
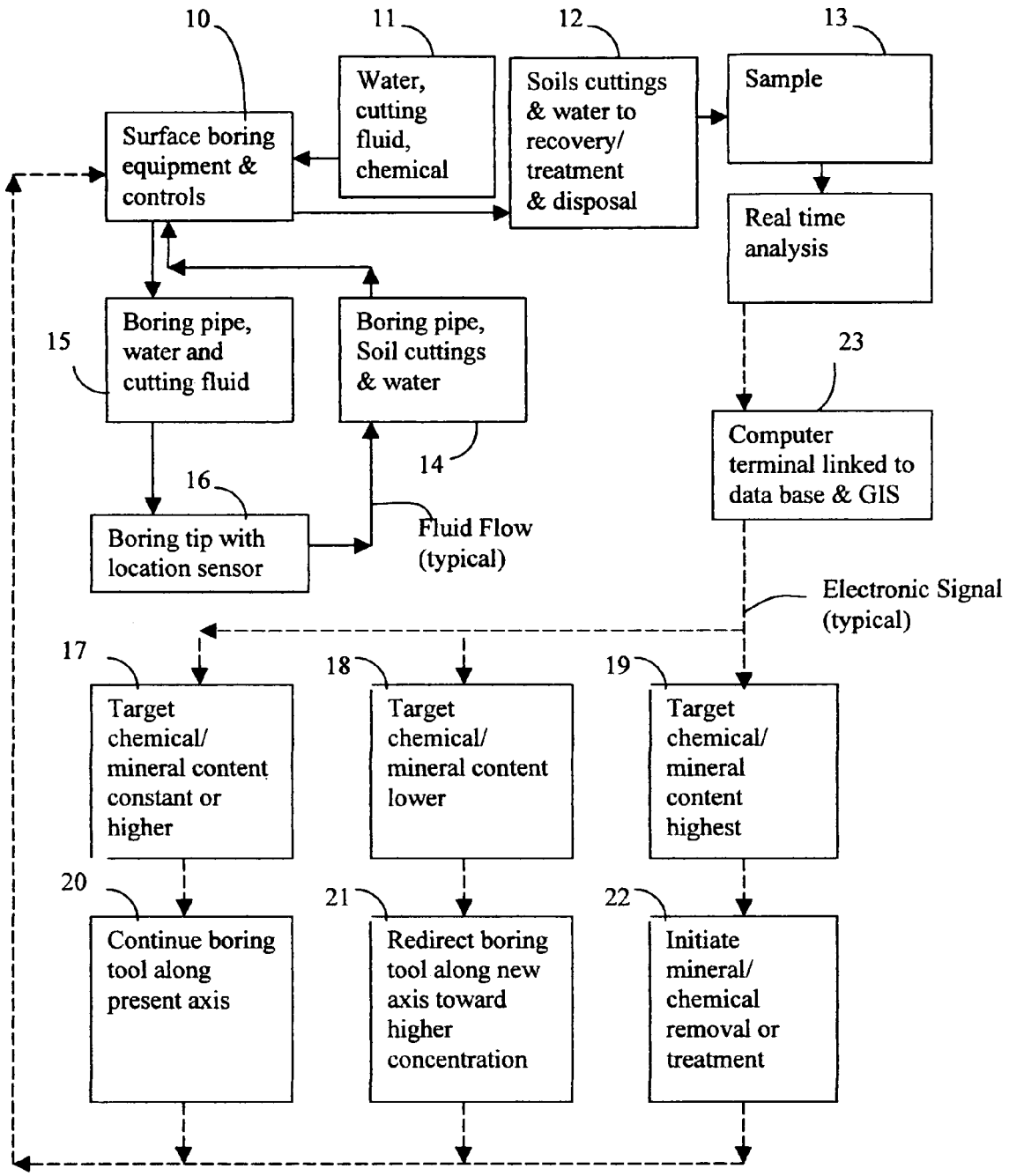

CLEAN-MOLE™ REAL-TIME CONTROL SYSTEM AND METHOD FOR DETECTION AND REMOVAL OF UNDERGROUND MINERALS, SALTS, INORGANIC AND ORGANIC CHEMICALS UTILIZING AN UNDERGROUND BORING MACHINE

BACKGROUND OF THE INVENTION

The present invention relates generally to the field of underground boring and, more particularly, to a system and process for detecting, plotting, locating and removal of organic and inorganic compounds in the subsurface with minimum environmental impacts.

One area of application is cleanup of polluted sites. The advantage of the invention is the detection and removal of contaminants at their source (often referred to as hot spots). A horizontal boring unit is assembled at the site and drilling initiated by directing the head at an inclined angle to the surface. Water or other fluid is injected continuously to remove soil and cuttings and transport to the surface where it is analyzed using a single or combination of volatile organic analyzer, combustion meter, chromatography, infrared and ultra-violet and mass spectroscopy, Geiger counter, wet test methods, pH, ORP, conductivity meters, infrared, X-ray Florescence, and/or Inductive Coupled Plasma. An operator continually analyzes the data and re-directs the boring head toward areas with the highest concentrations of contaminants. Once the location of a hot spot is determined, various methods can be utilized for removal and treatment. For light phase non aqueous liquids (LNAPL) such as gasoline (BETX) or dense phase non aqueous liquids (DNAPL) such as percholoroethylene (PCE) or trichloroethylene (TCE), one method is to insert a Well Evacuator™ in the pipe and aspirate liquid and vapor to the surface for treatment and disposal. To unlock remaining trace residuals, steam or hot air can be injected, followed by application of vacuum in a pulsed or continuous mode of operation.

Upon achieving low or non-detect or concentrations the boring tool is re-directed to remaining hot spots until the site is clean and ready for closure.

Likewise, pockets of polychlorinated biphenyl (PCBs) can be identified and removed from river beds. The Hudson river has large concentrations of PCBs that are the result of diffusion from silts into river water. PCBs are heavier than water and have low mobility and solubility. Removal by conventional dredging technologies is time consuming, expensive and may lead to additional contamination of river water by exposure to contaminated dredge spoils. Clean Mole™ is less invasive than dredging. A single pipe is inserted into the river bed minimizing disturbance of silt. Once a pocket of PCBs in located it is transported to the surface using Well Evacuator™ or other means for treatment and disposal. Remaining trace amounts of PCBs are then treated in-situ using anaerobic or other suitable technologies by injection of suitable microbes and nutrients.

Also, radioactive waste sites can be cleaned up at minimum cost and reduced personnel exposure. McClellan AFB, CA., Savanah River, N.C., Rocky Flats, Colo., and Richland Wash. are examples of sites where radioactive contaminants have been detected. Site investigation and treatment is very expensive using existing technologies. Clean Mole™ allows detection and treatment in-situ minimizing exposure and costs. Once the hot spot is detected, cement or other solidification/agents are injected rendering the radioactive contaminants immobile and reducing radioactivity to acceptable levels.

A second application is mining of minerals especially, precious minerals found in veins. Current practices are open pit mining and tunnel mining. These methods result in environmental damage in the form of abandoned mines that leach pollutants into our potable water resources. Using the Clean Mole™ technology minimizes tailings and destruction and reduces the costs of metals recovery. The boring tool is directed along the vein continually analyzing and transporting cuttings to the surface for treatment without creating large open pits that later become environmental problem areas. As an alternate, the tip of the boring tool is redirected to the surface and a larger auger or pipe is inserted in the formation allowing higher volumes of ore to be mixed with water and the slurry pumped or conveyed to the surface.

A third application is mapping of the sub-surface. Cuttings can be analyzed to determine both their chemical and physical nature. This information can be used to supplement existing well log boring data. Geologic Information Systems (GIS) can be constructed readily from this data to provide a accurate display of the subsurface. This data is valuable for placement of wells, pipes, conduits and cables at minimum costs.

The general technique of boring a horizontal underground hole, analyzing the cuttings real time, and using this information to locate and remove concentrated contaminants is a cost effective approach that saves time and money. Remediation is directed to the areas with highest concentrations of contaminants. In accordance with such a horizontal boring technique, also known as micro tunneling, horizontal directional drilling (HDD) or trench-less underground boring, a boring system is situated on the ground surface and drills a hole into the ground at an inclined angle with respect to the ground surface. A drilling fluid is typically flowed through the drill string, over the boring tool, and back up the bore hole in order to remove cuttings and dirt. The cuttings and drilling fluid are analyzed at the surface and the information evaluated through the use of operator knowledge to sophisticated computer models. Based on this information, an operator controls the direction of the boring tool head continually seeking areas of highest concentration of contaminants. Once a pocket of contaminants is located it is removed from the subsurface either directly by the boring tool or by conventional technologies such as excavation, pumping soils vapor extraction, and treated or destroyed. The entire process is completed in weeks to months rather than years or decades.

It can be appreciated that present methods of detecting and treating underground contamination is cumbersome, fraught with inaccuracies, and expensive. Moreover, the inherent delay resulting from sampling and analysis coupled with imprecise placement of wells in dilute contaminant streams adds costs and health risk during cleanup of sites. By way of example, the MEW site in Santa Clara County has spent tens of millions of dollars over 20 years in an attempt to clean up chlorinated solvents in ground water. The source is leaking underground storage tanks (LUST) that were used by manufacturers of semi conductors over thirty years ago. Although a considerable amount of money has been expended final cleanup and closure have not been attained and no accurate timeline has been established.

During conventional remedial investigation of contaminated sites vertical wells are punched or bored and a casing is placed to allow sampling of groundwater and/or soil vapor. Placement of the wells is often based on proximity to the original source such as an underground tank. If analysis exceed drinking water standards, additional sampling is conducted followed by installation of additional wells to define the extent of contamination. Health and ecological risk are evaluated and a remedial investigation report is prepared. Often additional wells are installed to monitor spread of contamination. Once the extent of contamination is established, feasibility studies are conducted to determine and select treatment options There exists a need in the excavation industry for an apparatus and methodology for analyzing, interpreting and controlling an underground boring tool to map the subsurface and provide an economical and environmentally friendly means for treatment of contamination and recovery of valuable minerals than is currently attainable given the present state of the technology. There exists a further need for such an apparatus and methodology that may be employed in vertical and horizontal drilling applications. The present invention fulfills these and other needs.

SUMMARY OF THE INVENTION

The present invention is directed to systems and methods for analyzing, data collection, mapping and extraction and treatment of compounds and minerals either in-situ or ex-situ. Various means are currently practiced for boring and placement of pipes, cable and conduits in the subsurface using horizontal boring or trench-less technology. One common method is to transmit signals from the tip of the boring tool to a receiver at the surface. Data from the receiver is used to determine the location of the boring tool. This data is then utilized to direct the tip along the same axis, or at a different angle. Boring tool designs vary in shape, size and nozzle arrangement. One design utilizes a shoe that is sloped toward the tip and nozzles for injection of water and cutting fluid. A pipe connected to equipment at the surface exerts pressure on the tip.

The tip is rigidly connected to the pipe and can be rotated at various angles at the surface thereby changing the direction of the boring from the surface. A second pipe or tube is inserted in the primary pipe to transport water (and cutting fluid if required) to the tip. Water and soil cuttings are conveyed through the annular space between the pipes to the surface for analysis, treatment, processing and/or disposal. The steering mechanism may include one or more of an adjustable plate-like member, an adjustable cutting bit, an adjustable cutting surface or a movable mass internal to the boring tool. The steering mechanism may also include one or more adjustable fluid jets. The boring tool may further include one or more cutting bits each of which includes a wear sensor for indicating a wear condition of the cutting bit.

One or more geochemical sensors may be deployed within the boring tool or external of the boring tool for sensing one or more geochemical characteristics of soil/rock along the underground path. The controller may further modify one or both of the rate and the direction of boring tool movement along the underground path in response to signals received from the geochemical sensors. A laser, spectoscopic unit and/or other geochemical sensors may be employed within or proximate the boring tool or, alternatively, within an aboveground system for detecting and characterizing the geology, chemistry or physical characteristics at the excavation site. The boring system may also include a graphical display representing the geochemical and physical characteristics of the subsurface.

The delivery of fluid, such as a cutting, chemical leaching agent and/or viscosity control fluid to the boring tool may be controlled during excavation. Various fluid delivery parameters, such as flow, temperature, pressure and concentration may be controlled. The viscosity of the fluid delivered to the boring tool, as well as the composition of the fluid, may be analyzed and controlled during boring activities. Adjustments may be made as a function of geochemical information, contaminant, rock or soil type, rotation torque, pullback or thrust force, etc.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

DRAWINGS

FIG. 1, Clean-Mole™ Block Diagram, illustrates material flow and control circuitry. Surface boring equipment & controls (10) at the surface inject water and/or chemical or fluid into a conduit or pipe (15) routed to the boring tip (16). Soil cuttings and fluid are collected and routed to the surface in a second pipe (14) annular space for treatment and disposal at the surface (12). Instruments (13) at the surface sample and analyze soil and fluid to determine organic and inorganic target chemicals and minerals. Data is entered into a computer terminal (23) and a subsurface map is generated showing concentrations of targeted chemicals and minerals. If concentrations are increasing (17) the boring tip is steered along its existing path (20). If concentrations are decreasing (18) the tip is redirected up, down, sideways or retracted and redirected. Once the location (22) of highest concentration is determined, chemical removal or treatment is initiated.

Figure 2:
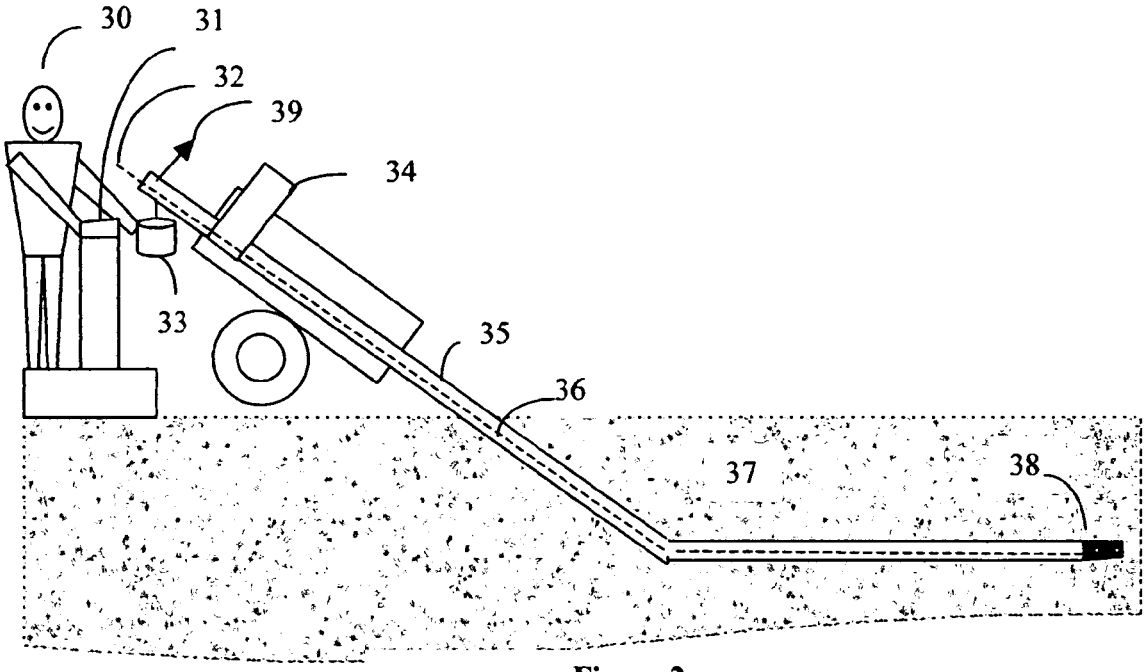

FIG. 2, Clean-Mole™ Mining Operation illustrates a process for extraction and recovery of minerals from the subsurface using horizontal boring technology. An operator (30) controls equipment (34) that injects fluid (32) into a pipe connected to a boring tip (38) that simultaneously injects fluid and extracts a slurry created with the soil cuttings. The slurry is routed to the surface in the annular space created by a second pipe (35) where it is analyzed (33), treated and/or disposed (39). Data is entered into a computer terminal (31). The operator redirects the boring tip to optimize removal or treatment of the target chemical and/or mineral. A map is created showing concentrations in the subsurface.

Figure 3:
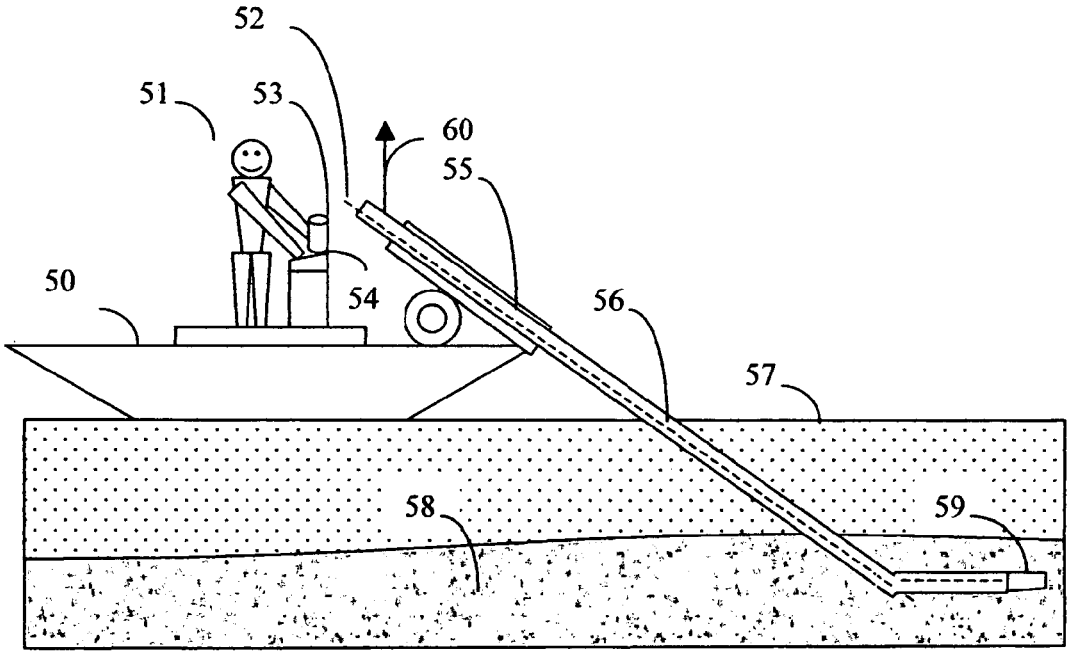

FIG. 3, Clean-Mole™ Dredge Application illustrates a process for extraction of PCBs and insitu treatment using horizontal boring technology. Equipment is supported by a barge (50) or platform. The bore tip is directed through water (57) into river or other water body bed (58) continually seeking pockets of concentrated PCBs. An operator (51) controls equipment (55) that injects fluid (52) into a pipe connected to a boring tip (59) that simultaneously injects fluid and extracts a slurry containing PCBs created with the soil cuttings. The slurry is routed to the surface in the annular space created by a second pipe (56) where it is analyzed (53), treated and disposed (60). After removing concentrated PCB, a fluid containing anaerobic microbes inducers and nutrients are injected (52) to decompose any remaining PCBs. Data is entered into a computer terminal (54). The operator continuously redirects the boring tip to optimize removal or treatment of the target chemical and/or mineral. A map is created showing concentrations in the subsurface.

UNIQUE ATTRIBUTES

Cleanup of contaminated sites and extraction of minerals is achieved at minimum cost and impacts to the environment. Unlike conventional technologies, Clean Mole is capable of extraction of materials with minimum surface disruption. Following is a table of unique attributes as compared with conventional cleanup technologies or mineral extraction methods.

| Description | Clean Mole | Conventional Cleanup & Mineral Extraction Methods |
|---|---|---|
| Efficiency | Quickly determines hot spots or high assay mineral concentration and provides robust removal at highest concentration areas. | Hit or miss; often drill multiple horizontal wells, mine shafts or open pit mine analyze data, followed by additional wells. Seldom find areas of highest concentration. Treat dilute streams over long periods. |
| Cost | Least cost; minimizes excavation, analytical data, wells installation, and expedites cleanup or mineral extraction of high assay ore. | Very expensive and time consuming. Superfund sites such as McClellan Air Force Base, Sacramento, CA. Costs hundreds of millions of dollars over decades to clean up. Open pit mines such as Midvale, Utah Sharon Steel site contains hundreds of acres of mine tailings containing toxic metals consisting of lead, arsenic and cadmium singly or in combination that have contaminated groundwater causing health problems. |
| Energy Sustainability | Minimal energy consumption per pound of contaminant or mineral removed. Concentrated streams contain orders of magnitudes more mineral, less air, groundwater, gangue per pound of material removed. | High energy costs per pound of mineral or contaminant removed. Often must remove and separate large volumes of water and air from contaminants or minerals. |
| Environmental Impacts | Greatly accelerates mining, cleanup of site and minimal disruption to the environment. Minimal emissions or impacts to surrounding communities. Minimizes ecological impacts in dredging operations. | Placement of horizontal wells and extraction and treatment of dilute streams results, spread of contaminants, additional contamination drinking water and emissions of pollutants to air. Extraction of minerals with large quantities of gangue results in large areas with spent tailings containing toxic metals and requiring reclamation. Conventional dredging operations disturb and often pollute delicate ecological systems.. |

What I claim is:

1. A process for determining areas of high concentrations of underground target compounds based on real-time chemical analysis of drill cuttings comprising the following steps:

a) horizontal boring means for drilling holes into the subsurface in which drilling fluid is flowed through a pipe or drill string, over the boring tool, and back up the bore hole to the surface in order to transport soil cuttings and groundwater to the surface, and b) sampling and analysis means for determining real-time chemical concentrations of target compounds in drilling fluid, and c) statistical means for determining if concentrations are increasing or decreasing, and d) optimization means for redirecting drill head along a path of increasing concentrations to pockets with greatest concentrations until concentrations peak, and e) mapping means for documenting isopleths concentrations of target compounds relative to location.

2. The method of claim 1, further including computer software to generate graphical display of concentrations relative to depth so that operator of said horizontal boring equipment can direct drill head toward area of higher concentration.

3. The method of claim 1, further including means for introduction of steam water or other fluids to enhance removal of contaminants or minerals from the subsurface.

* * * * *